United States Patent [19]

McGuire

[11] Patent Number: 5,015,022

[45] Date of Patent: May 14, 1991

[54] CHAIN LOCK FOR SLIDING DOOR

[76] Inventor: Michael D. McGuire, 116 Larchmont Acres West, Larchmont, N.Y. 10538

[21] Appl. No.: 345,129

[22] Filed: Apr. 28, 1989

[51] Int. Cl.[5] ..... E05C 17/04

[52] U.S. Cl. ..... 292/278; 49/325; 49/264; 292/DIG. 46

[58] Field of Search ..... 292/263, 264, 141, DIG. 46, 292/262, 278; 49/325

[56] References Cited

U.S. PATENT DOCUMENTS

| | | | |
|---|---|---|---|
| Re. 27,161 | 8/1971 | Raymon | 49/449 |
| 1,572,635 | 2/1926 | Bostwick | 49/325 X |
| 2,620,214 | 12/1952 | Caccetti | 49/325 X |
| 2,832,590 | 4/1958 | Youngberg | 49/325 |
| 3,352,586 | 11/1967 | Hakanson | 292/225 |
| 4,014,136 | 3/1977 | Hemens et al. | 49/325 |
| 4,429,912 | 2/1984 | Smith, Jr. | 292/DIG. 46 X |
| 4,580,820 | 4/1986 | Bober | 292/264 |

*Primary Examiner*—Richard E. Moore

*Attorney, Agent, or Firm*—Nolte, Nolte and Hunter

[57] ABSTRACT

A lock for a sliding panel such as a sliding glass door includes a chain which bends in only one direction. The chain, when latched, forms an incompressible column between the openward edge of the panel and the door frame. Unlatching allows the chain to bend in its allowed direction and fall vertically along side the door frame, thus allowing the panel to open.

7 Claims, 10 Drawing Sheets

CHAIN LOCK FOR SLIDING DOOR

FIELD OF INVENTION

The present invention relates to door locks, particularly to locks for sliding doors.

BACKGROUND OF THE INVENTION

In the field of locks for sliding glass doors, many of the commonly used locks have not been certain in their locking operation and have been relatively easily broken or tampered with. Most such locks have not had the capability for securely maintaining a door in a partially opened condition. Standard latches usually involve hooking onto the soft aluminum door frame. Such hooks can be easily forced.

Typical of attempts to overcome such deficiencies is U.S. Reissue Pat. No. 27,161 issued to Raymon as U.S. Pat. No. 3,420,001 on Jan. 7, 1969 and reissued on Aug. 10, 1971. That patent refers to a locking bar of adjustable length pivotally mounted at one end. In its operative locking position the bar is disposed in the horizontal guide track for the panel, and extends therein in a plane parallel to the plane of sliding movement of the panel. In the inoperative position the bar is disposed in the vertical channel guide track for the panel. The adjustable locking bar in its operative position has its free end engaged against the rear edge of the panel to prevent the panel from being moved rearwardly. Clamping means are positioned in the vertical channel guide track for releasably maintaining said locking bar in the inoperative position.

When confronted with a latching bar referred to in Raymon, an intruder need only slip a coat hanger between the frames of the glass door and pull up on the latching bar in order to free the door for opening. Furthermore, to disengage Raymon, the occupant must bend over and lift the latch from its operative position at floor level to its inoperative vertical position.

Another approach is referred to in Hakanson, U.S. Pat. No. 3,352,586, issued Nov. 14, 1967. Hankanson refers to a locking device for sliding windows and doors in which the end of a pivotable lock member mounted on a movable frame engages any one of the teeth of a corrugated member mounted on a stationary frame. A control member controls the positioning of the lock member and blocks it against disengagement from the corrugated member. In order to release the locking device, it is necessary to pull downwardly on pull chain 29, causing the control member 22 to pivot in a clockwise direction against the urging of spring 32.

Hankanson relies upon the integrity of a pawl and ratchet teeth and upon the security with which the corrugated member 35 is affixed to the top of a door frame. Such door frames are usually made of a soft aluminum.

OBJECTS

The present invention seeks to overcome these disadvantages by providing a locking mechanism which relies entirely upon compression against large surfaces in a strong manner. It seeks to provide secure attachment at both ends of the compression column: at the sliding panel end, and at the frame end. Another object of this invention is to provide a lock which an occupant can easily lock and unlock, while standing, without bending over. It is a further object of this invention to provide a lock which is positively secured in deadbolt fashion and yet is easily latched and released by its intended operator.

BRIEF DESCRIPTION

The present invention is a lock for any slider type of door, window, hatch, etc. The invention comprises a rigid chain; rigid in the sense of a bicycle drive chain in which each link can only move in one plane in relation to its neighbor link. In the present invention, the structure and geometry of the chain limits movements of the links, relative to each other, to only one direction in one plane. Each link of the chain comprises a blocking portion overlying the horizontal plane in which the link's pins lie. This blocking portion butts against blocking portions of adjacent links to prevent upward pivoting of the links with respect to each other. No such blocking means is found on the underside of the plane of the link pins and therefore the links are free to pivot down with respect to each other. Thus, the chain is free to bend in only one direction. Horizontal bending is restricted by the geometry of the links and pins, upward bending is restricted by the blocking portions, and downward bending is the only bending possible.

This chain is installed in the door frame with a free end affixed to a bracing means which firmly and positively secures the free end to the centerward top corner of a sliding door panel. The brace butts firmly against the centerward edge of the panel.

Latching means are secured to the door frame opposite centerward edge of the slider.

The latching means comprises a bearing mounted atop a pivoting arm pivoted at some distance below the upper corner of the frame and having a free end which can be moved in an arc to a position near said corner. This bearing is then used in its latched position to support a part of the chain against this corner of the frame. The chain is at least slightly longer than the distance from the centerward edge of the door to its opposite upper corner of the door frame. A portion of the chain thus bends down around said bearing. The latching arm is supported along its length by a strut mounted in a vertical chain housing along the vertical part of the door frame. This strut comprises a latching bolt means for holding the arm and bearing in their latched position. With the bearing in the latched position, the chain links provide an incompressible column or strut incapable of arcing downward and restrained from arcing upward by the upper leg of the door frame. Thus, positive latching of great strength is provided by a chain member which, being secured at both ends, is not easily unlatched by a person on the wrong side of the door. Yet the lock is easily unlatched by a person standing inside the door.

DETAILED DESCRIPTION OF THE DRAWINGS

Figure 1:
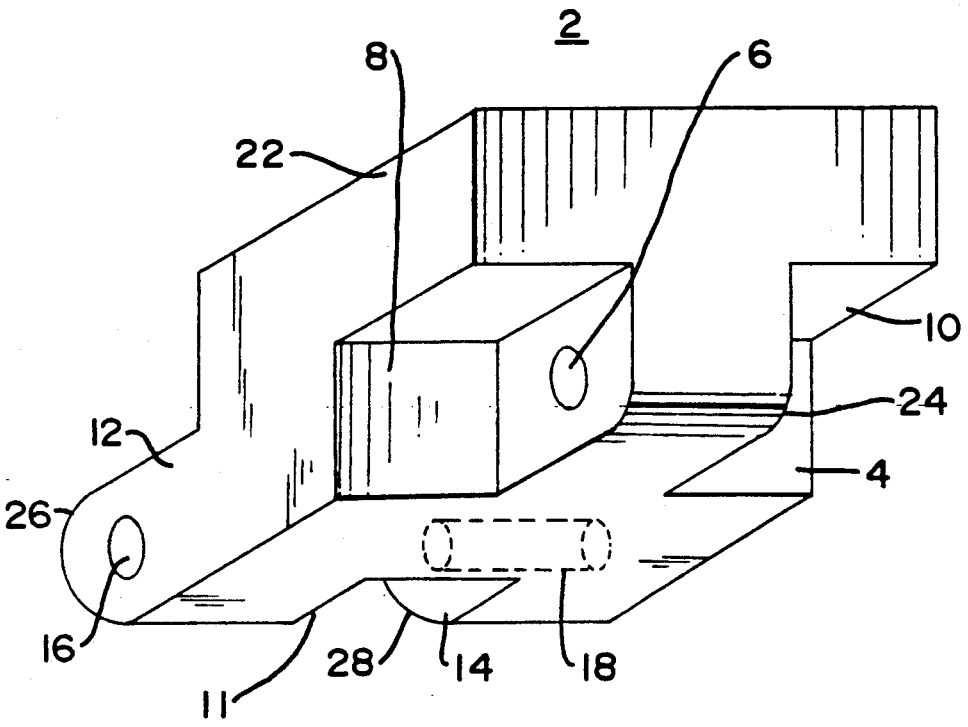
FIG. 1 is an oblique view of a link of the present invention.

FIG. 1 shows a link, generally designated 2, which comprises the chain of the present invention. Link 2 comprises tab 4. Tab 4 includes tab bore 6. Bore 6 connects recesses 8 and 10 flanking either side of tab 4. Tab 4 is designed to be received in an identical link in cutout 11 between brackets 12 and 14.

Brackets 12, 14 comprise bracket bores 16, 18. When two links are joined together, bores 16 and 18 on one link align with bore 6 on the other link to receive a pin which pivotably joins the two links together. Block 22 overlies the plane formed between the links. Tab corner 24 and bracket ends 26, 28 are rounded to facilitate downward pivoting of the links with respect to each other.

Figure 2:
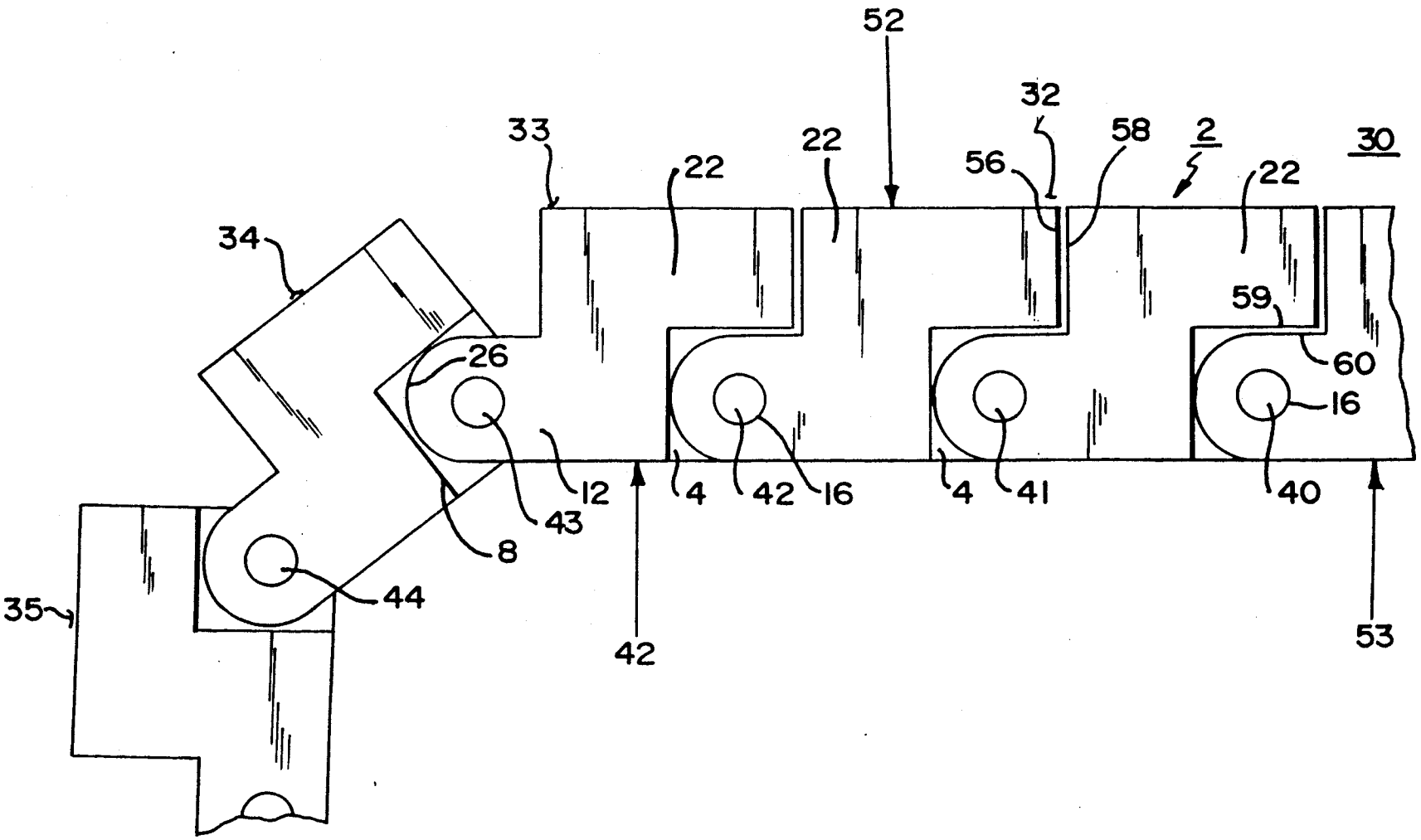
FIG. 2 is an elevation of a chain comprising a plurality of the links shown in FIG. 1.

FIG. 2 shows a section of chain comprising links such as link 2, shown in FIG. 1. In FIG. 2 links 2, 32, 33, 34, 35 are pivotably joined together by pins 40–44. Each pin has been inserted through bore 16 as shown in this figure and thence through bore 6 on a second link and bore 18 on the first link shown in FIG. 1. One of these bores may be sized to provide a friction fit with its pin. The pin may then be installed by being press fit and then located and held in place by its frictional fit with the single bore. Preferably, the press fit will be on bore 6, leaving bores 16 and 18 with sufficient clearance to provide free pivoting between the links.

As an alternative to press fitting pins such as 40 into the bores 16, 6, 18, the pin may be sized to fit loosely in all the bores and peened at each of the pin ends. Another alternative is to provide a groove cut around the circumference near each end of each pin and secure the pin to the links by fitting a c-clip or circlip into each groove.

Overlying the horizontal plane in which pivots 40–43 lie, each link has a block 22 which abuts the block of its adjacent link when the links are aligned straight along the longitudinal axis of the chain. Thus, in FIG. 2, when forces 51, 52 and 53 are applied to the chain, each block's 22 front face 56 butts with the back face 58 of its adjacent block 22 and the blocks 22 resist compression while pins 40–42 resist tension and the chain thereby resists bending in an upward direction. Recess surface 59 under block 22 also abuts bracket surface 60 for additional resistance to bending in this embodiment.

In the absence of such forces, chain link 34 is free to pivot upon pin 43 down with respect to link 33, and link 35 is similarly free to pivot down on pin 44 with respect to link 34. Thus, the chain, generally designated 30, bends in only one direction.

Figure 3:
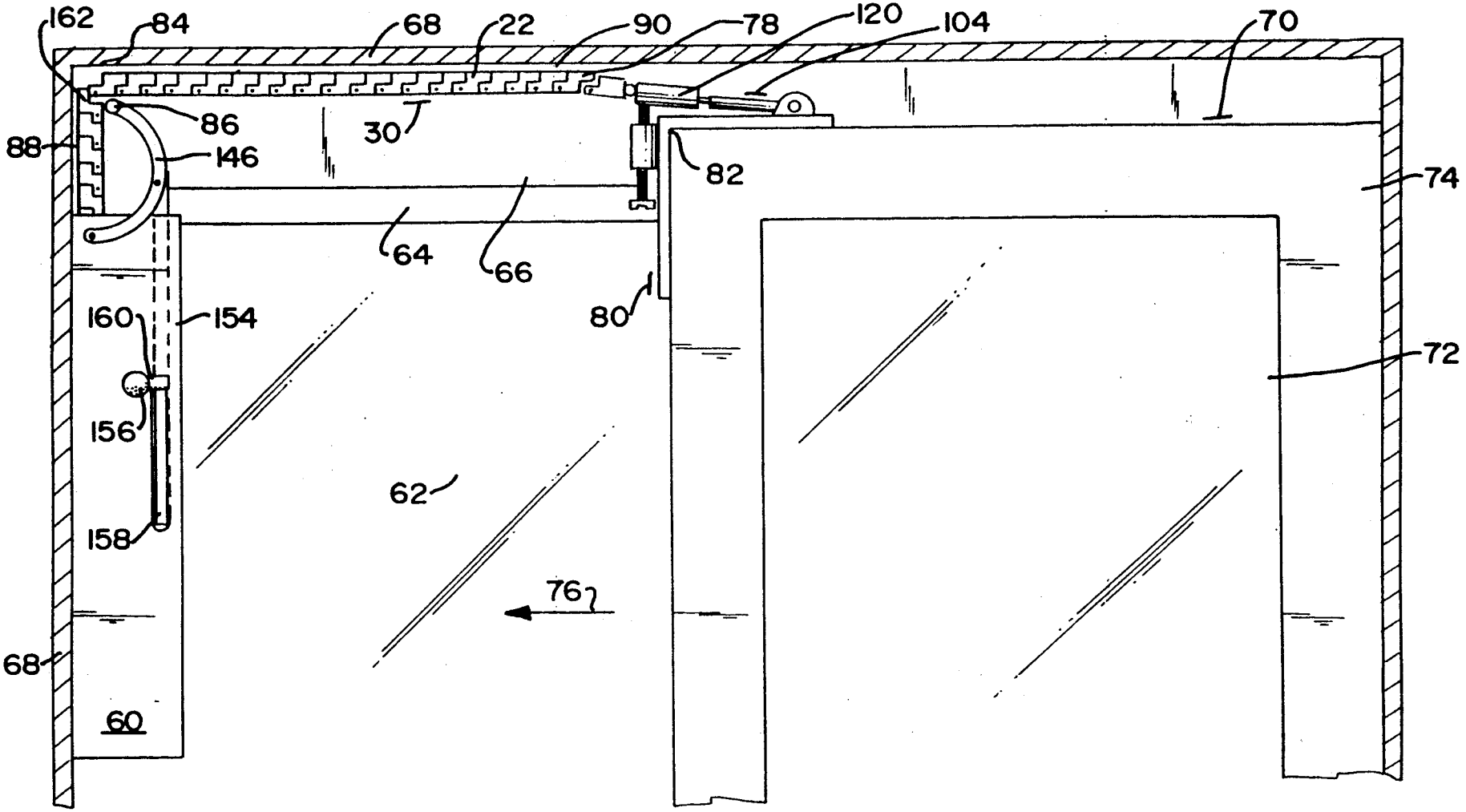
FIG. 3 is an elevation of the present invention installed on a sliding door with the door frame sectioned through the plane lying just outside of the innermost flange of the door frame.

FIG. 3 shows chain 30, installed as part of a lock, generally designated 60, in a sliding-panel type door.

The door comprises an outside non-moving panel comprising outside glass 62 which is framed by outside panel frame 64. Central flange 66 is disposed just inside of outside panel frame 64. Central flange 66 extends down from door frame 68 which is shown sectioned through a plane just outside of an inside flange which is not shown. Central flange 66 and the inside flange combine to support sliding door panel 70 comprising glass 72 and frame 74. Door panel 70 opens in the direction of openward arrow 76.

End 78 of chain 30 is affixed by brace 80 to upper openward corner 82 of panel frame 74. Part of chain 30 is held against upper openward corner 84 of door frame 68 by bearing 86.

In this position, when an attempt is made to open door panel 70 in direction 76, chain 30 butts against openward edge 88 of door frame 68 at corner 84. Since chain end 78 is braced by brace 80 firmly against door panel 70, the door panel 70 cannot be opened without compressing or buckling chain 30. Chain 30 is prevented from buckling upward by upper edge 90 of door frame 68. Chain 30 is also prevented from buckling in a downward bow by the presence of block 22 [see also FIG. 2] in each chain link, which block prevents each link from bending upwardly in relation to its neighbors. As in FIG. 3, chain 30 thus resists opening of the door as a solid and incompressible column or strut rigidly braced between the reaction surface that is door frame edge 88, and door panel 70.

In an attempt to force the door panel 70 open, all loads by the chain 30 are applied in a compressive manner against door frame edge 88 and door panel corner 82. Thus, there is no force directed toward pulling screws, in the longitudinal direction of the screws, from their screw holes in soft aluminum. Thus, the arrangement is extremely strong.

Figure 4:
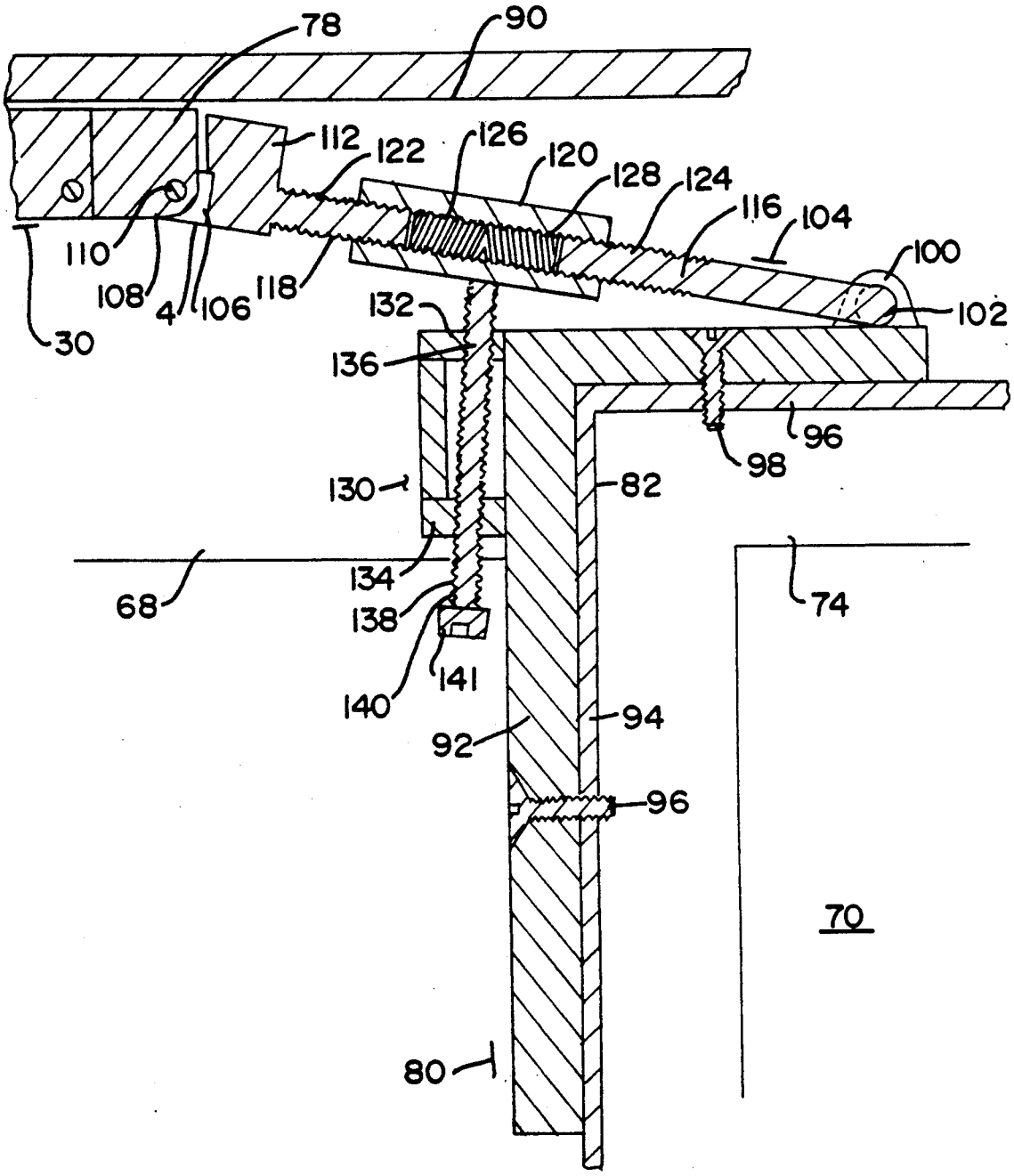
FIG. 4 is a detail of the panel end of the present invention shown in section through the center of the apparatus.

Brace 80 is shown in greater detail in FIG. 4. Brace 80 comprises an angle-iron 92 which butts against centerward edge 94 and top edge 96 of door panel frame 74 at corner 82. Brace 80 may be easily secured to this corner, without dismounting door panel 70 from door frame 68, by means of screw 96.

Adding screw 98 will contribute further to the rigidity of panel frame 74 but is not necessary. Adding screw 98 necessitates dismounting the door panel from the frame.

Pivot 100 is welded or cast as part of angle-iron 92 at the closedward end of angle-iron 92. Pin 102 pivotably mounts arm 104 to pivot 100 and thereby to angle-iron 92. At the opposite end of arm 104 is bracket 106 which comprises a bore 108 aligned on either side of bore 6 in tab 4 of end link 78.

Thus, any forces applied to the door to force the door open are transmitted by door frame 74 to the massively strong angle-iron 92 through strongly attached pivot 100, through arm 104 through pin 110 to link 78 and the rigid column of chain 30. This is a very strong arrangement but, in the event of any deformation of pin 110, block 112 will be forced against link 78 and continue to hold the door locked.

In order to achieve a proper link position at corner 84 of FIG. 3, when the panel 70 is locked in the closed position, adjustment means are provided on arm 104 for adjusting the position of link 78 in the openward-closedward directions. As shown in section in FIG. 4, arm 104 comprises two separate threaded rod segments 116, 118 connected by internally threaded tube 120. Threads 122 and 124 are reversed with respect to each other as are internal threads 126, 128 at either end of tube 120. Thus, arm 104 comprises a turnbuckle mechanism where, by rotating cylinder 120, the position of pin 108 may be adjusted.

Figure 5:
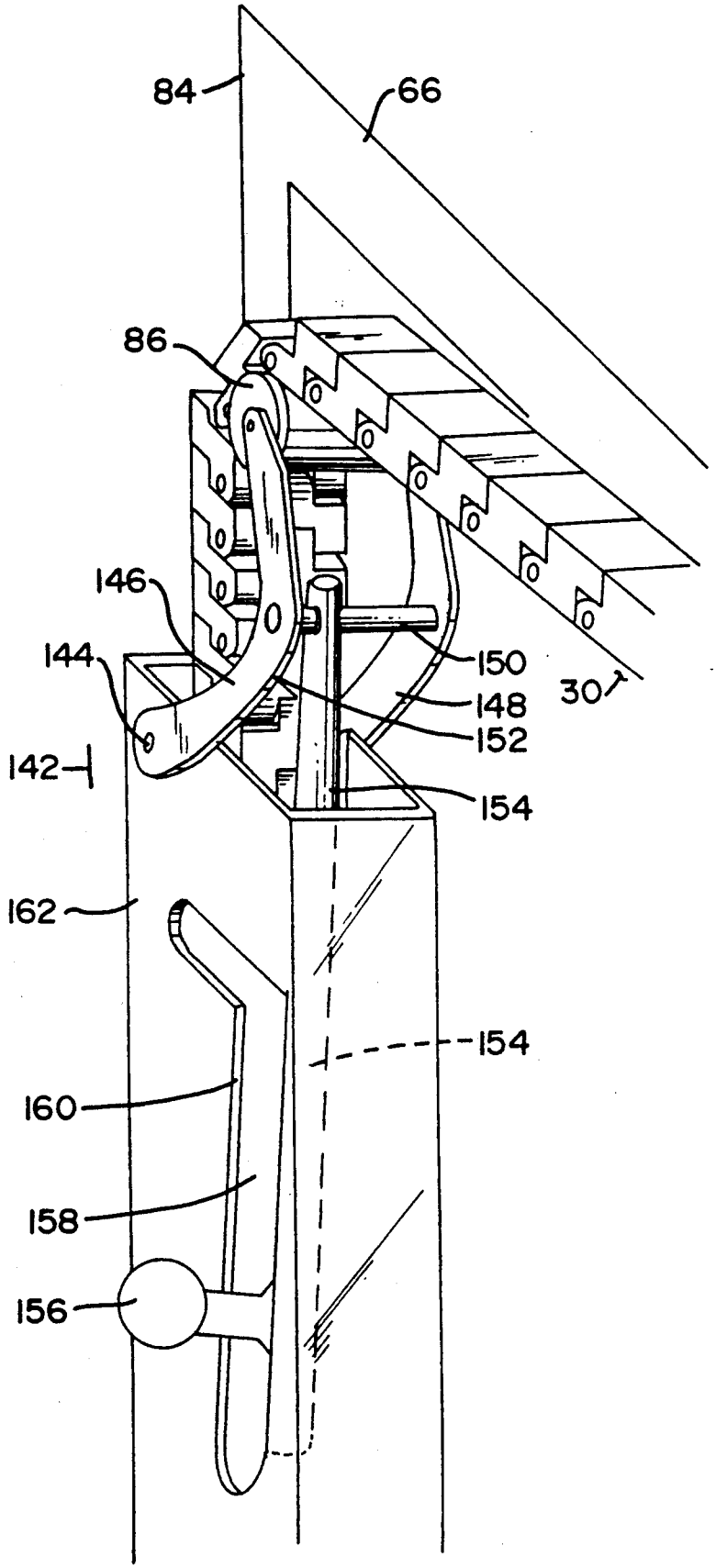
FIG. 5 is an oblique view of the latching mechanism of the present invention.

In order to retain chain 30 at the proper height near door frame edge 90, a vertical screw adjust means is included on bracing means 80. This vertical adjustment means 130 comprises a screw mount having in a top wall 132 and bottom wall 134 a pair of threaded holes 136, 138 through which screw 140 may be screw adjusted. Thus, vertical-adjust screw 140 butts against arm 104 to provide a proper vertical position for pin 110. Screw 140 is angled with its head 141 away from centerward panel edge 94 in order to provide clearance for a screwdriver handle. FIG. 5 shows the latching mechanism in detail in an unlatched condition. Bearing 86 is pivoted away from corner 84, and so chain 30 is free to roll across bearing 86 and fall freely into housing 142. Pivotably pinned by pins such as pin 144 to housing 142 are pivoting arms 146, 148 which support bearing 86. Arms 146, 148 are pinned by pin 150 through an oversized hole 152 in latching strut 154. Bolt handle 156 protrudes through L-shaped slot 158 defined by edge 160 in latch plate 162. When bolt handle 156 is at the bottom of slot 158, bearing 86 is pivoted away from corner 84 so that chain 30 is free to roll across bearing 86. Thus door panel 70, shown in FIG. 3, is free to slide open in direction 76. However, as shown in FIG. 3, When bolt handle 156 is raised to the top of slot 158 and latched into notch 160, strut 154 raises pivot arm 146 and forces bearing 86 against corner 84. Bearing 86 must be small enough to bear on the two links at the corner. Because link 162 must be flush against edge 88 when door panel 70 is in a closed position, turnbuckle 120 is used to adjust the longitudinal position of the chain.

To lock the door panel 70 in a partially opened condition, simply slide bolt handle 156 out of notch 160 to the bottom of slot 158, open door 70 to the desired width and then push bolt handle 156 back up into position 160. Bearing 86 will then jam a new pair of links into corner 84 and the door will again not be movable in an openward 76 direction.

Figure 6:
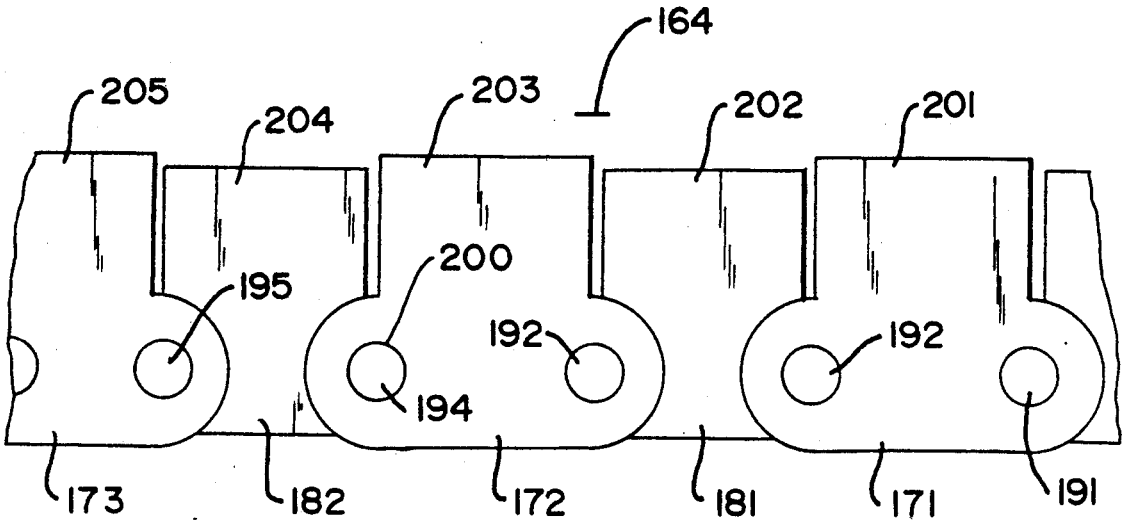
FIG. 6 is an elevation of an alternative embodiment of a chain of the present invention.

FIG. 6 shows an alternative embodiment of the chain made by techniques similar to those used to construct a bicyle chain. Chain 164 comprises bracketing links 171, 172 and 173 which overlap bracketed links 181 and 182 and are joined by pins 191–196. These pins such as 194 extend through holes such as 200 at either end of each link. Overlying parts 201–205 of each link serve the same blocking function as the blocks 22 shown in FIGS. 1 and 2.

Figure 7:
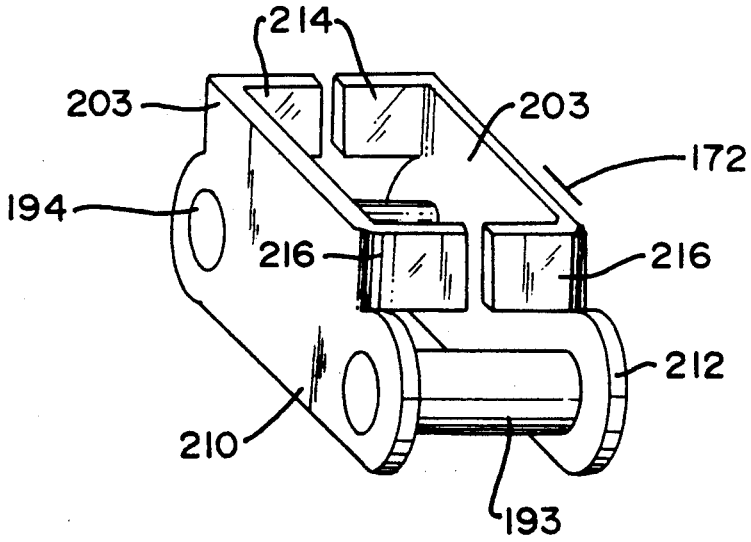
FIG. 7 is an oblique view of a single link of said chain.

FIG. 7 is an oblique view showing a bracketing link. Link 172 comprises a pair of identical link plates 210, 212. Each plate has a blocking section 203, the ends of which comprise bent tabs 214, 216 which serve to butt against similar tabs on neighboring links as shown in FIG. 8.

Figure 8:
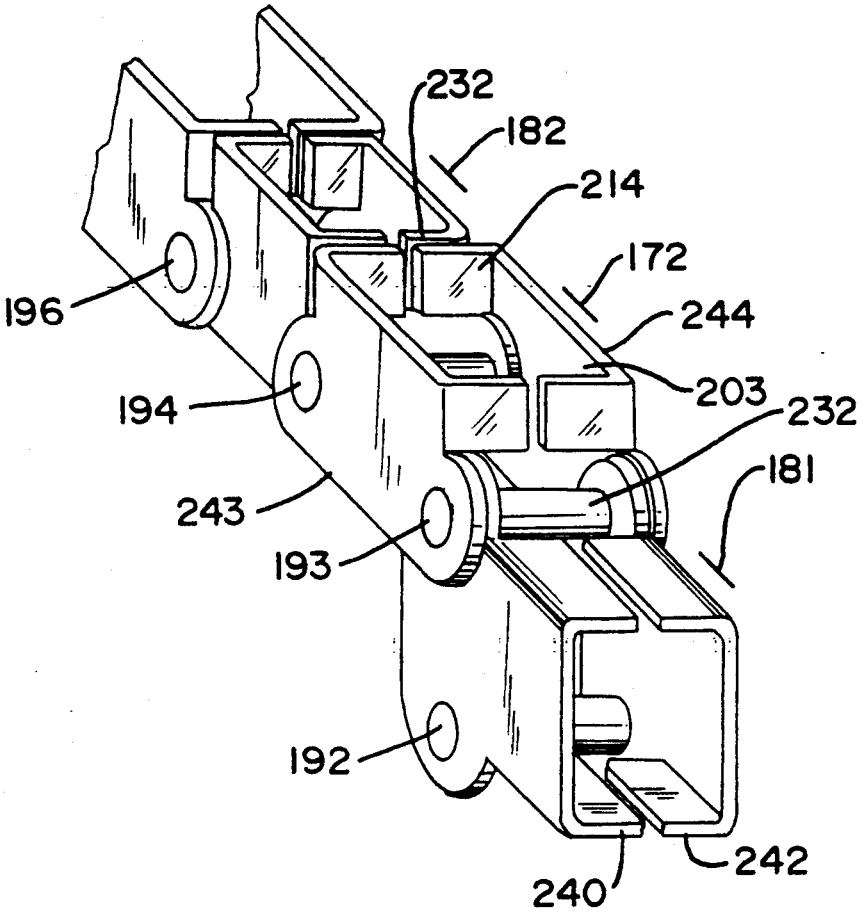
FIG. 8 is an oblique view of a plurality of such links forming such a chain.

FIG. 8 shows bracketing link 172 in the company of its bracketed adjacent neighbor links 181, 182 and forming a chain, generally designated 230. End plates 214 are shown butting against end plates 232 of link 182. Pins such as pins 193–194 join links 181, 182 and 172 while blocking portions 203 prevent the links from bending upwardly relative to each other. Pins, such as 193, may be press-fitted tightly into bracketed links such as 181 and the bracketing links can be held on the pins by circlips, c-clips, or peening on the pins. Alternatively, the pins may be press-fitted into the bracketing links and the bracketed links may comprise a spacer tube through which pins such as 193 can be passed. Spacer tubes, which would be in the position indicated by 232, would provide proper spacing for link plates 240, 242. Peening and circlip techniques as described above are also usable on both sides of link plates 240, 243 and 242, 244 to secure the axial positions of the link plates on pins such as 193.

Figure 9:
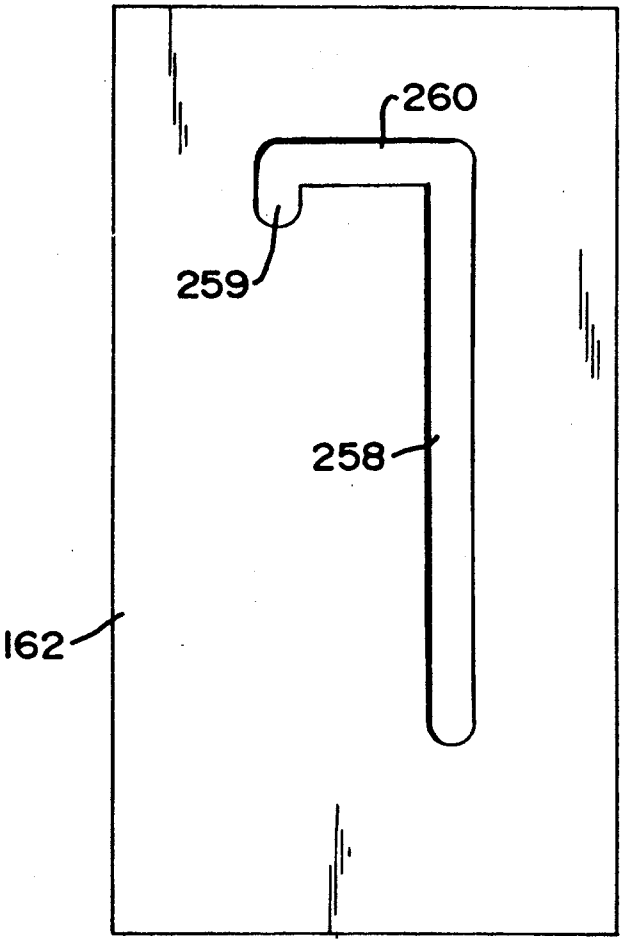
FIG. 9 is an elevation of an alternative latch plate.

FIG. 9 shows an alternative slot 258 in latch plate 162. Slot 258 has an additional notch 259 depending from notch 260. Since the bolt handle must be lifted upward out of notch 259 in order to unbolt the latching mechanism, this is a more difficult arrangement to unlatch from the wrong side of the door.

Figure 10:
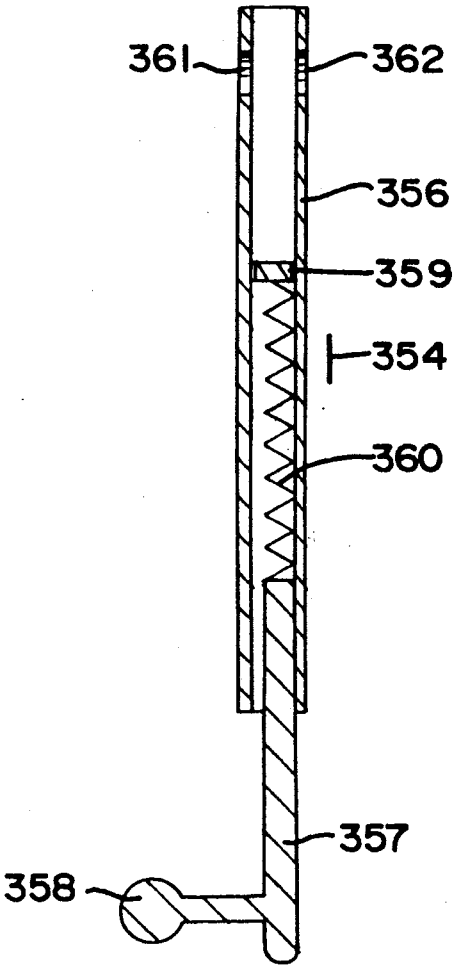
FIG. 10 is an elevation in section through the center of an alternative embodiment of the latching strut.

Slot 258 is used in conjunction with strut 354, shown in section through its center in FIG. 10. Bolt 354 comprises tube 356 within which is slidably located bolt 357 from which extends bolt handle 358. Wall 359 serves as a reaction plane for spring 360, which spring biases tube 356 from bolt 357. Holes 361, 362 extend through tube 356 and serve to mount pin 150, shown in FIG. 5. Using strut 354 with slot 258, shown in FIG. 9, handle 358 may be jammed to the top of notch 260 even though that will cause the uncompressed spring to push bearing 86 in [FIG. 3] to the full extent of its travel, shoving link 162 against edge 88 in corner 84. Since this bearing and chain cannot go beyond this point, the spring 360 [FIG. 10] compresses, allowing handle 358 to travel across notch 260 [FIG. 9] and to be sprung back into notch 259. This allows more positive latching in that the spring tension of 360 [FIG. 10] must be overcome to raise handle 358 out of notch 259 [FIG. 9] and unlatch the lock. This arrangement also provides more positive securement where door panel 70 [FIG. 3] is secured in a partially open position. If link 162 in FIG. 3 is in a half-cocked position when bolt handle 358 [FIG. 10] is shoved into the latching position, spring 360 will still maintain the links at the corner as close to the corner as possible. If an attempt is made to force the door, link 162 [FIG. 3] will then be shoved into the full cocked position and its adjacent link will be forced against the top edge of corner 84. This will secure the locking. Furthermore, the door may be closed without unlatching bolt handle 358 [FIG. 10], since spring 360 will permit bearing 86 [FIG. 3] to be moved away from corner 84 as the chain is drawn under tension past said bearing.

In the foregoing specification the directions normally associated with up and down have, for convenience, described a lock in which the chain is located at the top of the door frame. However, it is to be understood that it would be a functional equivalent of this device to invert the chain and place it at the bottom of the door frame using spring means such as a shock cord to take up a tail of the chain, said spring means serving the function that gravity serves in feeding the chain into the chain housing in the preferred embodiment.

Further, with such a spring arrangement, the chain could block a sliding panel and prevent its opening, no matter what direction the panel slid open in. In such case, "up" shall be defined as the direction toward the edge of the portal frame against which the chain is mounted.

Figure 11:
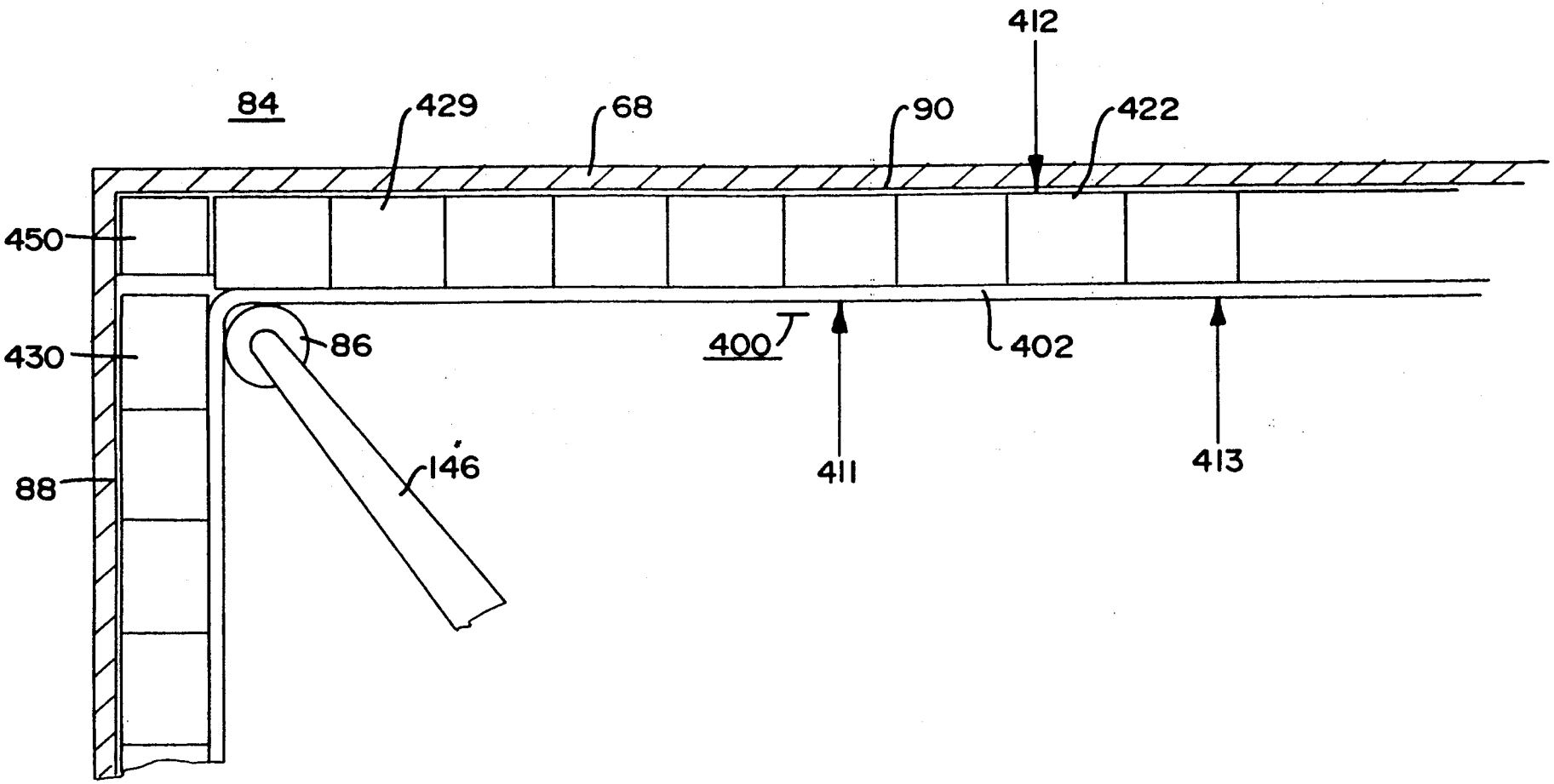
FIG. 11 is an elevation of another embodiment of the chain taken in section as is FIG. 3 through the plane lying just outside of the innermost flange of the door frame.

FIG. 11 shows another embodiment of the chain, in this case generally designated 400. This embodiment has an advantage of being relatively simple to set up the manufacturing of. In chain 400, the linking and pin means comprise a belt 402 relatively wide in relation to its thickness made of a material which is flexible and resistant to stretch on its longitudinal axis. Belt 402 is fastened by adhesive or by mechanical fasteners such as rivets, staples, or screws beneath a plurality of abutting blocks such as 422. When forces such as 411, 412 and 413 are applied to chain 400, belt 402 resists tension along the lower surface of belt 400 while blocks such as 422 resist compression along the upper surface of belt 400. Thus, the belt 400 resists bending in the direction of forces 411, 412 and 413. However, as can be seen at corner 84, belt 402 and its associated blocks 429, 430 have bent around bearing 86, because the flexible belt 402 bends freely in that direction and blocks 429, 430 do not impede bending in that direction. Thus, chain 400 comprises a rigid chain which bends in only one direction. Under an openward force by a sliding panel door, the column of blocks 422-429 resists the compressive loads along its longitudinal axis. Block 450, not attached to chain 400, is provided as a reaction surface at corner 84 so that these compressive loads may be taken between block 429 and block 450. Block 450 thereby relieves the compressive load which would otherwise be carried by the adhesive joint between block 429 and belt 402. Belt 402 may be of materials such as Dacron cloth, Kevlar, Nylon webbing, Mylar film or fiberglass reinforced tape with longitudinal fibers.

When bearing 86 is swung on pivot arm 146 away from corner 84, chain 400 rolls easily over bearing 86 and functions similarly to previously described chains.

The chain of blocks such as 422–429 can be easily fabricated by cutting a piece of wood of appropriate width and height at even intervals across the wood's longitudinal axis. With the grain of the wood running the length of the chain, the blocks will have great dimensional stability along their length.

Figure 12:
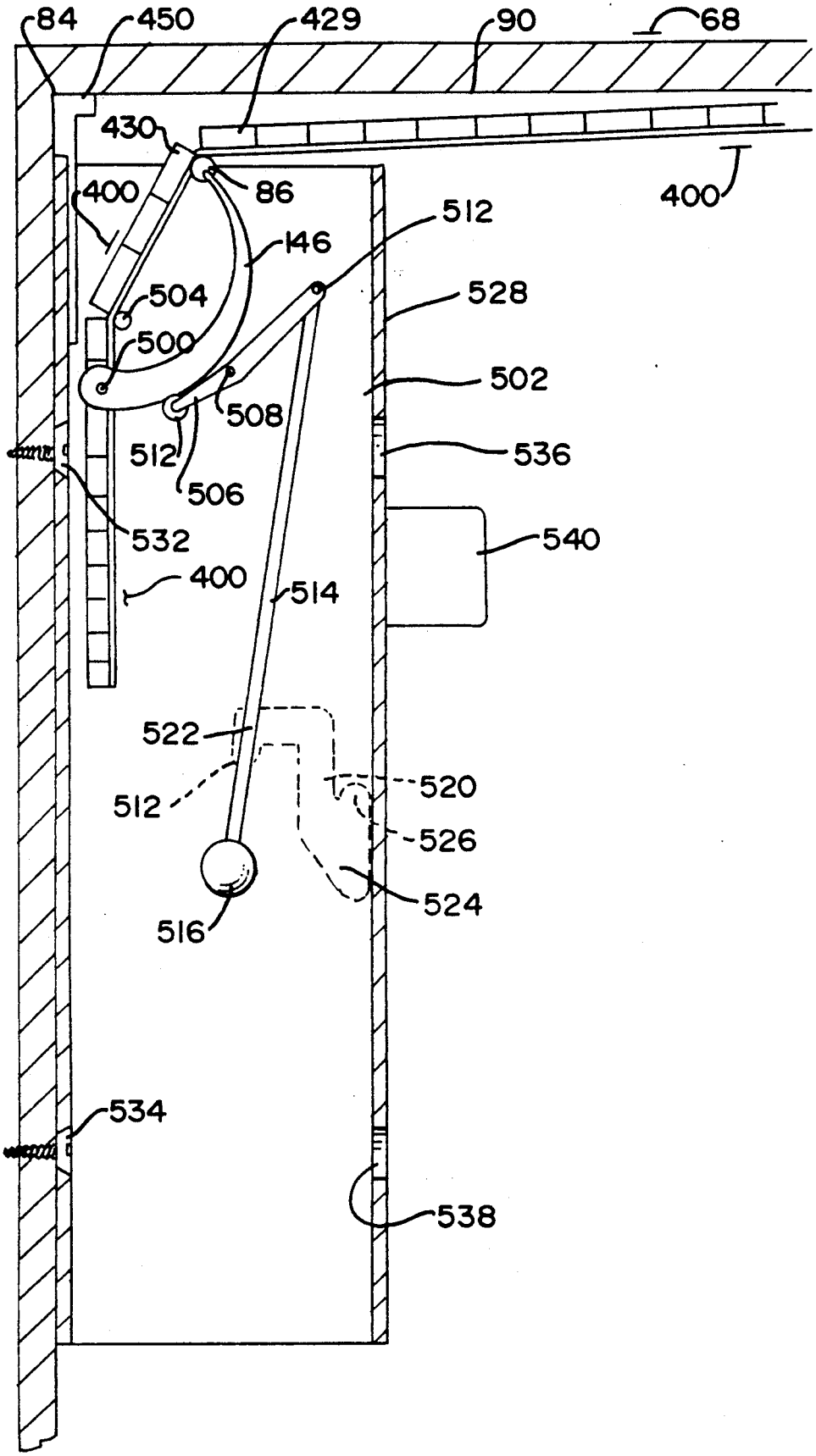
FIG. 12 is an elevation of an alternative embodiment of the latching assembly taken in section through a plane just inside the front of the housing. A slot and bolt handle, which are viewerward of the section plane, are shown in phantom in dotted lines.

FIG. 12 shows an alternative embodiment of the latching assembly. Chain 400, from FIG. 11, rolls across bearing 86, which in FIG. 12 is shown pivoted away from corner 84. Bearing 86 is mounted on pivot arm 146 which is pinned by pin 500 to the front cover of latch assembly housing 502, shown sectioned through a vertical plane just inside the front cover of the housing. Chain 400 bends freely around bearing 86 and rolls across it easily and thence hangs down across bearing 504, which it bends around, and hangs down freely into housing 502. Lever 506 is pinned to the housing by pin 508 on which it is pivotably mounted. At the openward end of lever 506, bearing 510 rolls along pivot arm 146 and supports, raises and lowers arm 146. At the opposite end of lever 506, pin 512 joins lever 506 to latch-bolt 514. Latch-bolt 514 comprises counterweight 516. Counterweight 516 is sufficiently heavy to pull up bearing 510 against pivot arm 146 and bias pivot arm 146 and bearing 86 against corner 84, supporting both the weights of the pivot arm 146 and of chain 400 against said corner. Bolt handle 518, shown in phantom in dotted lines, lies viewerward of the section plane and rides in latch-bolt slot bolt 520, also located viewerward of the section plane and also shown in phantom in dotted lines. When in notch 522 as shown, bolt handle 518 supports bolt 514 and its counterweight in a raised position so that bearing 510 is lowered and bearing 86 is away from corner 84 in a position over which chain 400 can roll freely. When bolt handle 522 is out of slot 518, gravity pulls counterweight 516 down so that bolt handle 518 falls to position 524 in slot 520. This raises bearing 510 and pivot arm 146 which rides thereon. This pushes bearing 86 against corner 84 and causes block 429 to butt against block 450 at the corner.

If block 430 should be in a half-cocked position on bearing 86 and prevent proper butting of block 429 against block 450, counterweight 516 will maintain pressure from bearing 510 against arm 146 and bias bearing 86 toward corner 84. When the chain has been moved sufficiently that the openward end of block 429 butts against block 450, bearing 86 will swing into its most cornerward position and maintain chain 400 in the locked position.

When the assembly is in the latched position, bolt handle 518 rests in area 524 and pin 512 is pivoted out toward wall 528 of housing 502. This tends to place the suspension point of bolt 514 over notch 526 so that an attempt to defeat the latch by pulling on pivoting arm 146 will cause bolt handle 518 to jam up into notch 526 and prevent bearing 86 from swinging clear of the latched position. Additionally, wall 528 extends up near upper edge 90 of door frame 68 in order to make pivoting arm 146 more difficult to access. Thus, bolt handle 518 must be positively grasped and shoved up against the weight of counterweight 516 into notch 522 in order to properly unlatch chain 400.

Block 450 is connected to housing 502 by connector plate 530 which extends up from the openward wall of housing 502. This provides proper clearance between the latching assembly and top edge 90 of door frame 68.

When mounting the latching assembly, the installer locates the latching assembly by placing block 450 against corner 84.

The assembly is mounted to door frame 68 by a pair of sheet metal screws such as 532, 534 which are accessed through holes 536, 538 in wall 528 of housing 502. Rubber stopper 540 provides some cushioning between the latching assembly housing 502 and the sliding panel when the panel is slid into housing 502.

I claim:

1. A lock for a sliding panel comprising chain means for bending in only one direction, said chain means comprising:
- a plurality of links;
- pin means for joining said links in the chain; and
- blocking means, overlying a plane formed by said pin means, for preventing each link from pivoting, with respect to its adjacent link, in a direction of the blocking means;
- means for attaching one end of the chain means to the sliding panel;
- latching means for holding a portion of the chain means against a corner of a frame;
- the attachment means comprising:
  - bracing means for attaching the end of the chain means to a corner of the sliding panel and for applying resistance to an openward edge of said panel;
  - horizontal adjustment means for adjusting the position of the chain links in an openward direction; and
  - vertical adjustment means for adjusting the clearance of the chain to the frame.

2. Apparatus according to claim 1 in which the latching means comprises:
- bearing means for bearing the chain means;

pivot arm means for holding said bearing means; and bolt means, pinned to said pivot arm means, for releasably supporting said bearing means and the chain means against a corner of the frame.

3. Apparatus according to claim 2 in which the bolt means comprises spring means for biasing said bearing means and the chain means against the corner of the frame in a latched position.

4. A lock for a sliding panel, said lock comprising chain means:

for preventing said chain means from bending in three orthogonal direction;

for forming a strut and bracing the panel against openward motion; and for permitting said chain means to bend in a fourth orthogonal direction for permitting openward motion of the panel;

said lock comprising latching means for holding a portion of the chain against a reaction surface, said latching means comprising:

bearing means for bearing the chain means;

counterweight means for biasing the bearing means against the reaction surface; and linking means for linking the counterweight means to the bearing means and for transmitting a gravitational force from the counterweight means to bias the bearing means against the reaction surface.

5. A lock for a sliding panel, said lock comprising:

chain means for bending in only one direction, said chain means comprising:

linking means for joining together elements of said chain; and blocking means, overlying a plane formed by said linking means, for preventing the chain from bending in a direction of the blocking means;

means for attaching one end of the chain means to the sliding panel;

latching means for holding a portion of the chain means against a corner of a frame;

said latching means comprising bearing means for bearing the chain means;

pivot arm means for holding said bearing means;

lever means, for supporting said pivot arm means;

bolt means pinned to said lever arm means for controlling the position of said lever arm means;

counterweight means attached to said bolt means for biasing the bolt means downward and thereby biasing the bearing means in a latched position;

bolt handle means extending from the bolt means for controlling the position of the bolt means; and slot means for guiding the bolt handle means and for maintaining the bolt in latched and unlatched positions.

6. A lock for a sliding panel comprising a chain including pivoted links having means for restricting pivoted movement to one direction, for forming a rigid lock bar, in a plane occupied by the panel in a closed position, when restrained against linear movement.

7. A lock for a sliding panel comprising a chain including links pivotally connected one to the other, the adjacent surfaces of which comprise means for blocking pivotal movement of said links in one direction for forming a rigid locking bar, in a plane occupied by the panel in a closed position, when said chain is restrained against linear movement.

* * * * *